US009807498B1

(12) United States Patent
Harmke et al.

(10) Patent No.: US 9,807,498 B1
(45) Date of Patent: Oct. 31, 2017

(54) SYSTEM AND METHOD FOR BEAMFORMING AUDIO SIGNALS RECEIVED FROM A MICROPHONE ARRAY

(71) Applicant: MOTOROLA SOLUTIONS, INC., Schaumburg, IL (US)

(72) Inventors: Charles B. Harmke, Huntley, IL (US); Kurt S. Fienberg, Plantation, FL (US)

(73) Assignee: Motorola Solutions, Inc., Chicago, IL (US)

( * ) Notice: Subject to any disclaimer, the term of this patent is extended or adjusted under 35 U.S.C. 154(b) by 0 days.

(21) Appl. No.: 15/254,822

(22) Filed: Sep. 1, 2016

(51) Int. Cl.
*H04R 1/40* (2006.01)
*H04R 3/04* (2006.01)
*H04R 1/08* (2006.01)

(52) U.S. Cl.
CPC ..... *H04R 1/406* (2013.01); *H04R 1/08* (2013.01); *H04R 3/04* (2013.01)

(58) Field of Classification Search
CPC . H04R 1/406; H04R 1/08; H04R 3/04; H04R 2201/40; H04R 2201/401; H04R 2201/403; H04R 2201/405
USPC ..... 381/92; 700/94
See application file for complete search history.

(56) References Cited

U.S. PATENT DOCUMENTS

| | | | | |
|---|---|---|---|---|
| 7,565,288 | B2 * | 7/2009 | Acero | G10L 21/0208 381/92 |
| 9,313,572 | B2 | 4/2016 | Dusan et al. | |
| 9,313,599 | B2 | 4/2016 | Tammi et al. | |
| 2013/0287224 | A1 * | 10/2013 | Nystrom | H04R 3/005 381/92 |
| 2014/0093091 | A1 | 4/2014 | Dusan et al. | |
| 2014/0126744 | A1 * | 5/2014 | Petit | H04R 3/005 381/92 |
| 2014/0270231 | A1 | 9/2014 | Dusan et al. | |

* cited by examiner

*Primary Examiner* — David Ton
(74) *Attorney, Agent, or Firm* — Michael Best & Friedrich LLP

(57) ABSTRACT

System and method for beamforming audio signals received from a microphone array. The method includes receiving at least one audio signal from the microphone array. The method includes determining a plurality of beams based on the at least one audio signal. The method includes receiving from a vibration microphone at least one vibration signal, and filtering the at least one vibration signal to generate at least one filtered vibration signal. The method includes filtering the plurality of beams to generate a plurality of filtered beams. The method includes determining a plurality of correlation values, each of the plurality of correlation values based on one of the plurality of filtered beams and the at least one filtered vibration signal. The method includes determining a peak correlation value based on the plurality of correlation values, and selecting one of the plurality of beams based on the peak correlation value.

20 Claims, 9 Drawing Sheets

SYSTEM AND METHOD FOR BEAMFORMING AUDIO SIGNALS RECEIVED FROM A MICROPHONE ARRAY

BACKGROUND OF THE INVENTION

Some microphones, for example, micro-electro-mechanical systems (MEMS) microphones, have an omnidirectional response (that is, they are equally sensitive to sound in all directions). However, in some applications it is desirable to have an unequally sensitive microphone. A remote speaker microphone, as used, for example, in public safety communications, should be more sensitive to the voice of the user than it is to ambient noise. Some remote speaker microphones use beamforming arrays of multiple microphones (for example, a broadside array or an endfire array) to form a directional response (that is, a beam pattern). Adaptive beamforming algorithms may be used to steer the beam pattern toward the desired sounds (for example, speech), while attenuating unwanted sounds (for example, ambient noise).

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
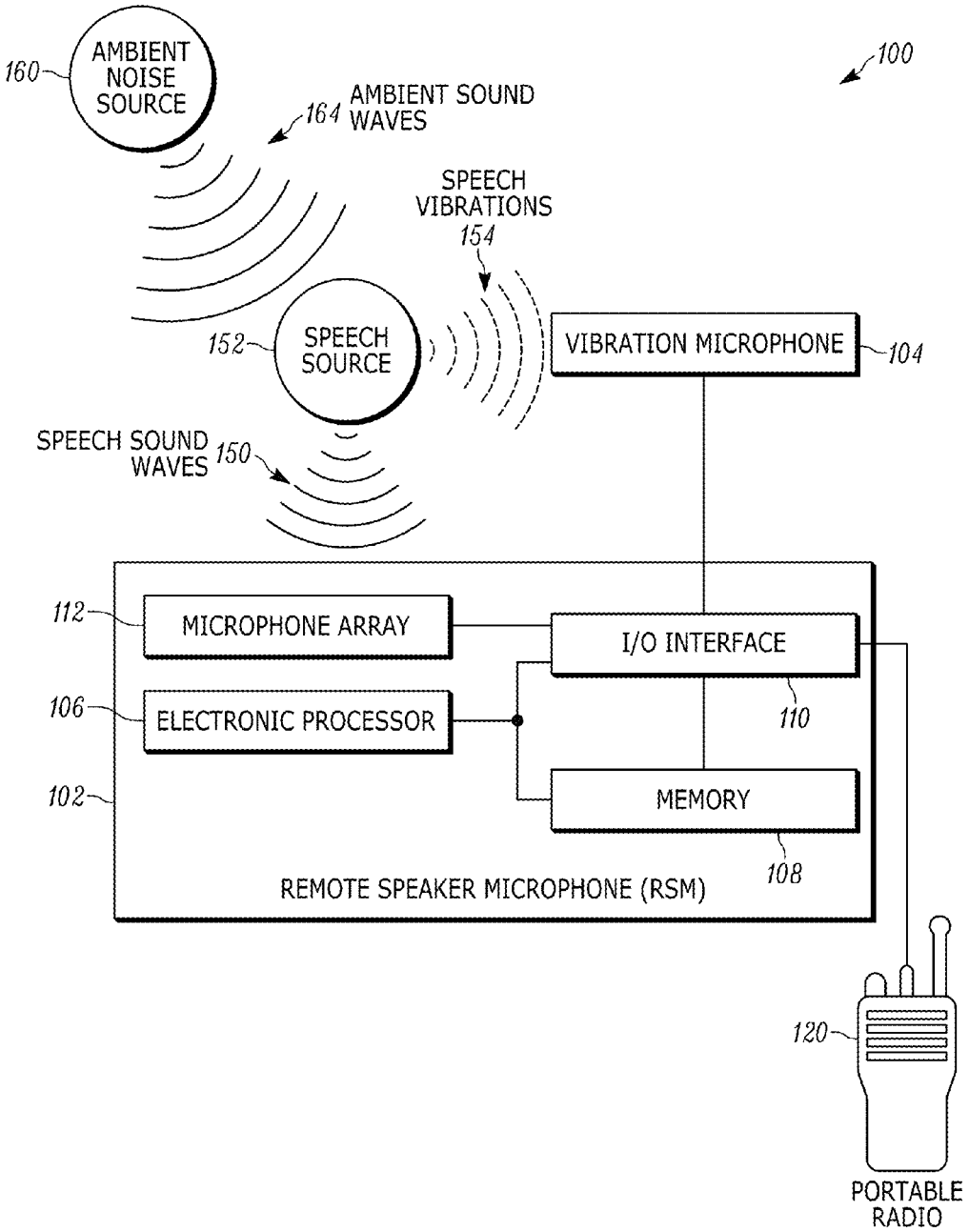
FIG. 1 is a block diagram of a beamforming system, in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

One exemplary embodiment provides a method for beamforming audio signals received from a microphone array. The method includes receiving, by an electronic processor communicatively coupled to the microphone array, at least one audio signal from the microphone array. The method includes determining a plurality of beams based on the at least one audio signal. The method includes receiving, by the electronic processor, from a vibration microphone communicatively coupled to the electronic processor, at least one vibration signal. The method includes time aligning the at least one vibration signal and the at least one audio signal. The method includes determining a plurality of correlation values, each of the plurality of correlation values based on one of the plurality of beams and the at least one vibration signal. The method includes determining a peak correlation value based on the plurality of correlation values, and selecting one of the plurality of beams based on the peak correlation value.

Another embodiment provides a beamforming system. The beamforming system includes a microphone array, a vibration microphone, and an electronic processor communicatively coupled to the microphone array and the vibration microphone. The electronic processor is configured to receive at least one audio signal from the microphone array. The electronic processor is configured to determine a plurality of beams based on the at least one audio signal. The electronic processor is configured to receive from the vibration microphone at least one vibration signal. The electronic processor is configured to time align the at least one vibration signal and the at least one audio signal. The electronic processor is configured to determine a plurality of correlation values, each of the plurality of correlation values based on one of the plurality of beams and the at least one vibration signal. The electronic processor is configured to determine a peak correlation value based on the plurality of correlation values, and select one of the plurality of beams based on the peak correlation value.

Another embodiment provides a remote speaker microphone. The remote speaker microphone includes a microphone array, a vibration microphone, and an electronic processor communicatively coupled to the microphone array and the vibration microphone. The electronic processor is configured to receive at least one audio signal from the microphone array. The electronic processor is configured to determine a plurality of beams based on the at least one audio signal. The electronic processor is configured to receive from the vibration microphone at least one vibration signal. The electronic processor is configured to time align the at least one vibration signal and the at least one audio signal. The electronic processor is configured to determine a plurality of correlation values, each of the plurality of correlation values based on one of the plurality of beams and the at least one vibration signal. The electronic processor is configured to determine a peak correlation value based on the plurality of correlation values, and select one of the plurality of beams based on the peak correlation value.

For ease of description, some or all of the exemplary systems presented herein are illustrated with a single exemplar of each of its component parts. Some examples may not describe or illustrate all components of the systems. Other exemplary embodiments may include more or fewer of each of the illustrated components, may combine some components, or may include additional or alternative components.

It should be noted that, in the following specification, the terms "beamforming" and "adaptive beamforming" refer to microphone beamforming using a microphone array, and one or more known or future-developed beamforming algorithms, or combinations thereof.

FIG. 1 is a block diagram of a beamforming system 100. The beamforming system includes a remote speaker microphone (RSM) 102 (for example, a Motorola® APX™ XP Remote Speaker Microphone) and a vibration microphone 104. The remote speaker microphone 102 includes an electronic processor 106, a memory 108, an input/output (I/O) interface 110, and a microphone array 112. The electronic processor 106, the memory 108, the input/output interface 110, the microphone array 112, as well as the other various modules are coupled directly, by one or more control or data buses, or a combination thereof. The remote speaker microphone 102 is communicatively coupled to a portable radio 120 to provide input (for example, for example speech via the microphone array 112) to and receive output (for example, audio output) from the portable radio 120. The portable radio 120 may be a portable two-way radio, for example, one of the Motorola® APX™ family of radios.

The memory 108 may include read-only memory (ROM), random access memory (RAM), other non-transitory computer-readable media, or a combination thereof. The electronic processor 106 is configured to retrieve instructions and data from the memory 108 and execute, among other things, instructions to perform the methods described herein.

The input/output interface 110 is configured to receive input and to provide system output. The input/output interface 110 obtains information and signals from, and provides information and signals to (for example, over one or more wired and/or wireless connections), devices both internal and external to the remote speaker microphone 102 (for example, the microphone array 112, the portable radio 120, and the vibration microphone 104).

The microphone array 112 includes two or more microphones capable of sensing sound, for example, the speech sound waves 150 generated by a speech source 152 (for example, a human speaking). The microphone array 112 converts the speech sound waves 150 to electrical signals, and transmits the electrical signals to the electronic processor 106 via the input/output interface 110. The electronic processor 106 processes the electrical signals received from the microphone array 112 according to the methods described herein. The electronic processor 106 provides the processed electrical signals to the portable radio 120 for voice encoding and transmission.

The vibration microphone 104 is a microphone capable of sensing vibrations, for example, the speech vibrations 154 made by the speech source 152. The vibration microphone 104 is communicatively coupled to the electronic processor 106 via the input/output interface 110. The vibration microphone 104 converts the speech vibrations 154 to electrical signals, and transmits the electrical signals to the electronic processor 106 via the input/output interface 110.

Although the vibration microphone 104 and the microphone array 112 both convert speech signals from the speech source 152 into electrical signals, they differ in at least three respects.

First, unlike the microphone array 112, the vibration microphone 104 senses vibrations in the speech source, and not sound waves transmitted through the air. In some embodiments (for example, using a bone conduction microphone, an in-ear microphone, or a tooth bone conduction microphone), the vibration microphone 104 senses the speech vibrations 154 through direct physical contact with the speech source 152. In other embodiments (for example, using a laser or other optical microphone), the vibration microphone 104 senses the speech vibrations 154 without direct physical contact with the speech source 152.

Second, when an ambient noise source 160 (for example, a vehicle, a crowd, or environmental noise) produces ambient sound waves 164, the microphone array 112 picks up both the speech sound waves 150 and the ambient sound waves 164. However, the vibration microphone 104, even in the presence of the ambient sound waves 164, picks up only the speech vibrations 154 generated by the speech source 152.

Third, the vibration microphone 104 is sensitive to vibrations within a limited frequency range, for example 100 Hz to 1 KHz, and outputs electrical signals having a corresponding frequency range. However, this range does not contain enough speech spectrum to be encoded by a typical voice encoder and used as a primary audio input to a transmitter of the portable radio 120.

Oftentimes, the speech source 152 is not the only source of sound waves near to the remote speaker phone 100. For example, a police officer using the remote speaker phone 100 may be in an environment with an ambient noise source 160 (for example, in a vehicle, or in a crowd), which produces ambient sound waves 164. In order to assure timely and accurate communications, the microphones of the microphone array 112 are configured to produce a directional response (that is, a beam pattern) to pick up desirable sound waves (for example, from the speech source 152), while attenuating undesirable sound waves (for example, from the ambient noise source 160).

Figure 2:
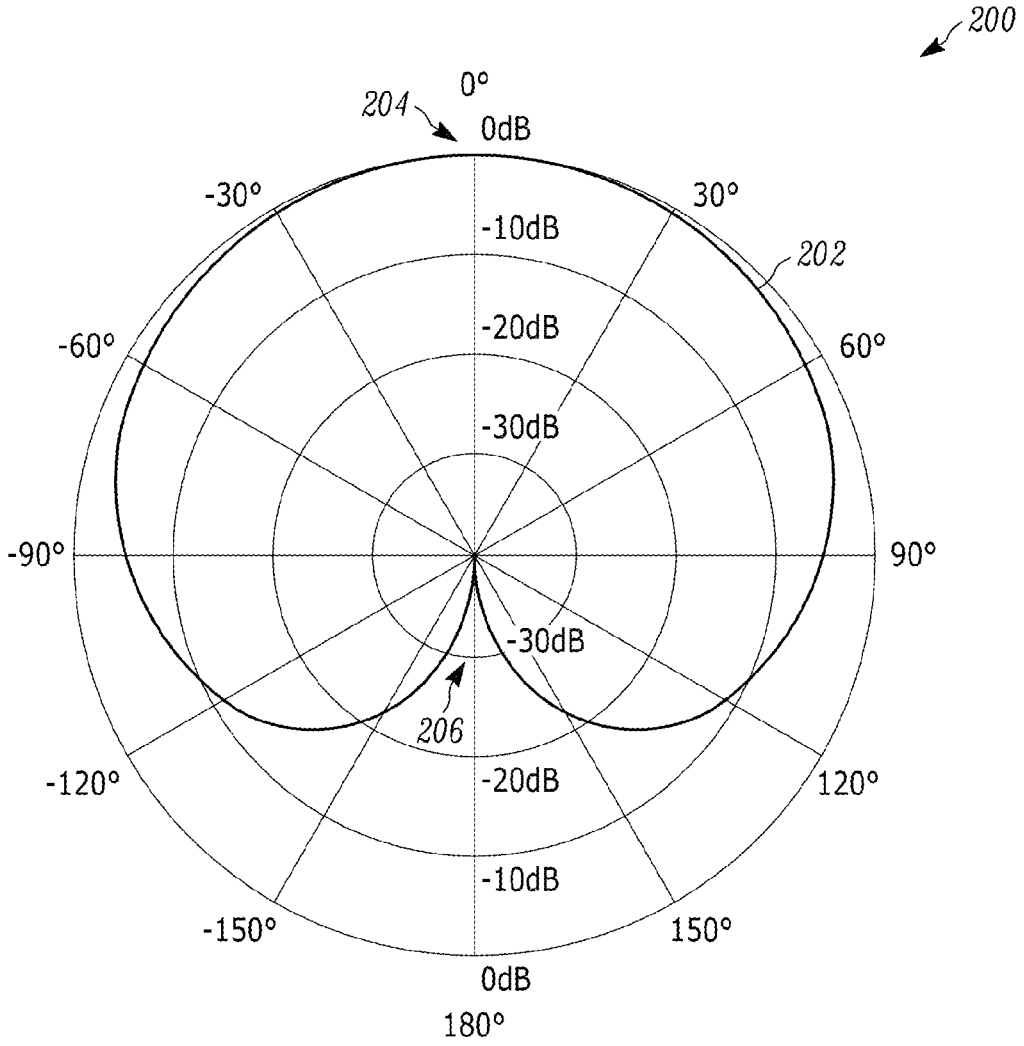
FIG. 2 is a polar chart of a beam pattern for a microphone array.

In one example, as illustrated in FIG. 2, the microphone array 112 may exhibit a cardioid beam pattern. FIG. 2 is a polar chart 200 that illustrates an exemplary cardioid beam pattern 202. As shown in the polar chart 200, the beam pattern 202 exhibits zero dB of loss at the front 204, and exhibits progressively more loss along the sides until the beam pattern 202 produces a null 206, which exhibits thirty or more dB of loss. Accordingly, sound waves arriving at the front 204 of the beam pattern 202 are picked up, sound waves arriving at the sides of the beam pattern 202 are partially attenuated, and sound waves arriving at the null 206 of the beam pattern are fully attenuated.

Adaptive beamforming algorithms use electronic signal processing (for example, executed by the electronic processor 106) to digitally "steer" the beam pattern 202 to focus on a desired sound (for example, speech) and to attenuate ambient noise. Accordingly, beamforming algorithms may be used with a microphone array (for example, the microphone array 112) to isolate or extract speech sound under noisy conditions. However, current beamforming algorithms are effective with a signal-to-noise ratio (SNR) down to about zero dB, at which point the algorithms struggle to separate speech from ambient noise. Thus, in high ambient noise situations, the signal-to-noise ratio may not be sufficient for current beamforming algorithms to correctly steer the beam pattern 202.

Figure 3:
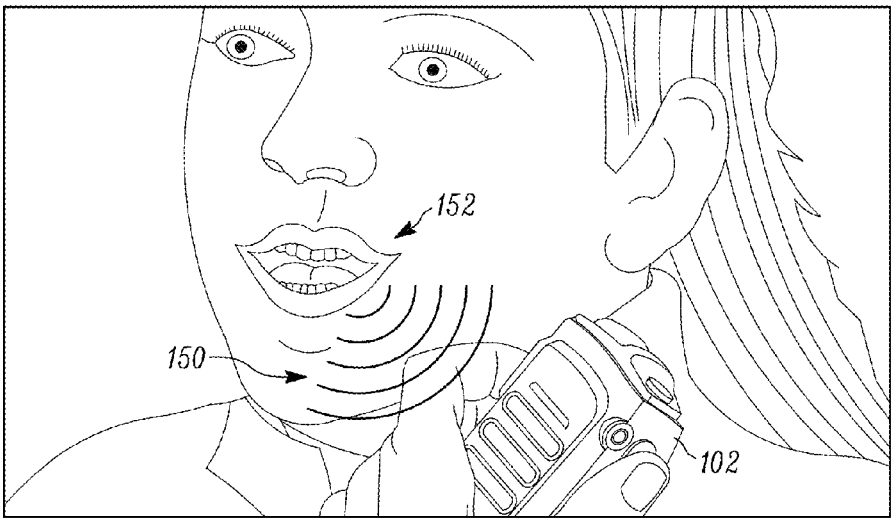
FIG. 3 and FIG. 4 illustrate a police officer using a remote speaker microphone in accordance with some embodiments.
Figure 4:
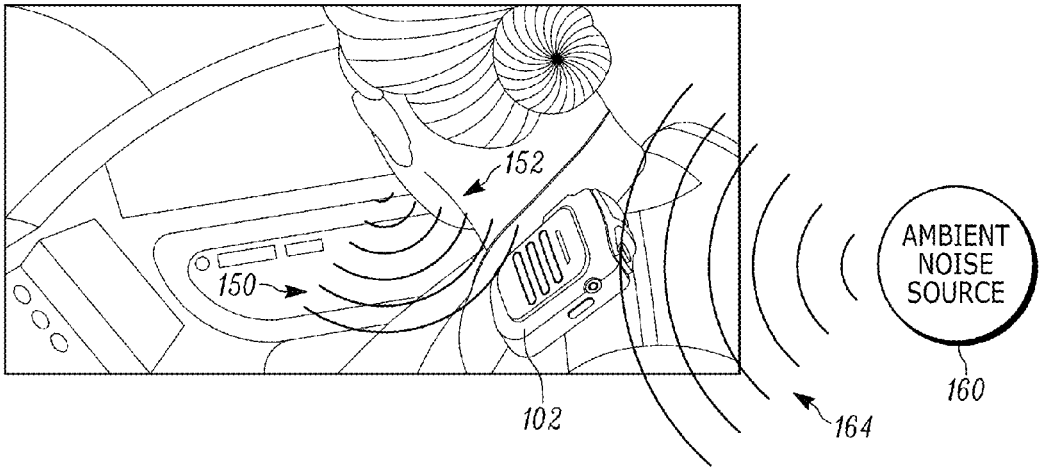

For example, in FIG. 3, an officer (that is, the speech source 152) is aiming her voice (that is, the speech sound waves 150) at the remote speaker microphone 102. The proximity and direction of the speech sound waves 150 (that is, toward the microphone array 112) keep the signal-to-noise ratio at zero dB and above. As a result, the microphone array 112 is able to pick up the officer's voice, despite some level of ambient noise. However, as illustrated in FIG. 4, the officer may continue speaking and turn her head away from the remote speaker microphone 102. When this occurs, the speech sound waves 150 that are not aimed directly at the remote speaker microphone 102 combine with the ambient sound waves 164, which may result in a signal-to-noise ratio below zero dB. Accordingly, in some environments, using current beamforming algorithms, the electronic processor 106 and the microphone array 112 may not be able to form a beam that picks up the speech sound waves 150, while reducing effect of the ambient sound waves 164.

As noted above, the vibration microphone 104 remains unaffected by ambient noise, but only captures useful audio between 100 Hz and 1 KHz. However, between 100 Hz and 1 KHz, the electrical signals produced from the speech vibrations 154 highly correlate to the electrical signals produced from the speech sound waves 150 for the same speech source 152.

Figure 5A:
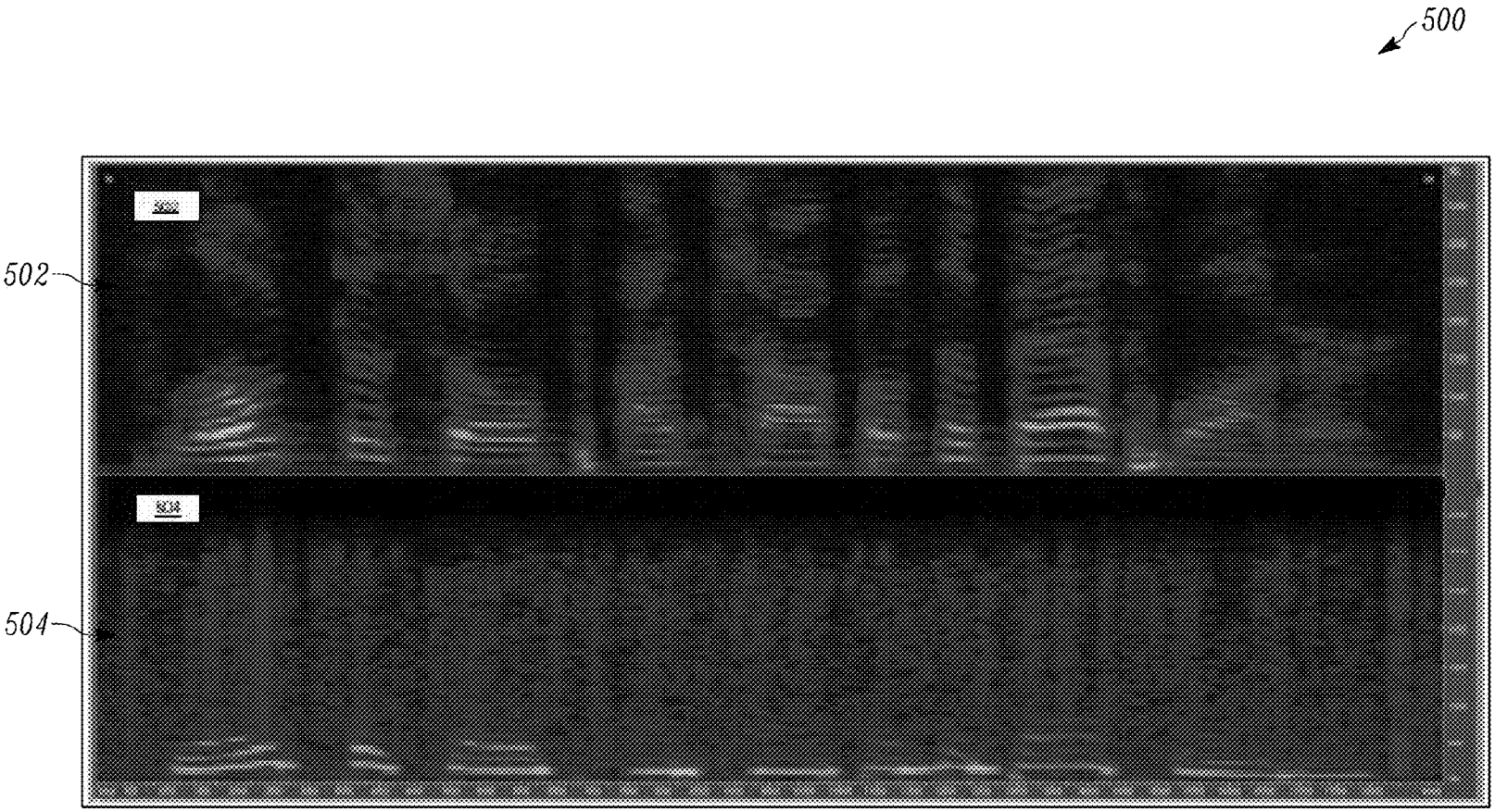
FIG. 5A is a spectral analysis chart of a speech signal, produced in a low ambient noise environment, as received by a microphone array and a vibration microphone, in accordance with some embodiments.

For example, FIG. 5A illustrates a spectral analysis chart 500 of a speech signal produced by the speech source 152 (see FIG. 1) in a low ambient noise environment. The spectral analysis 502 shows the electrical signals produced by the microphone array 112 in response to receiving the speech sound waves 150. The spectral analysis 504 shows the electrical signals produced by the vibration microphone 104 in response to receiving the speech vibrations 154. As shown in the chart 500, the electrical signals produced by the microphone array 112 and the vibration microphone 104 exhibit a high degree of correlation in the frequency range of 100 Hz through 1 KHz.

Figure 5B:
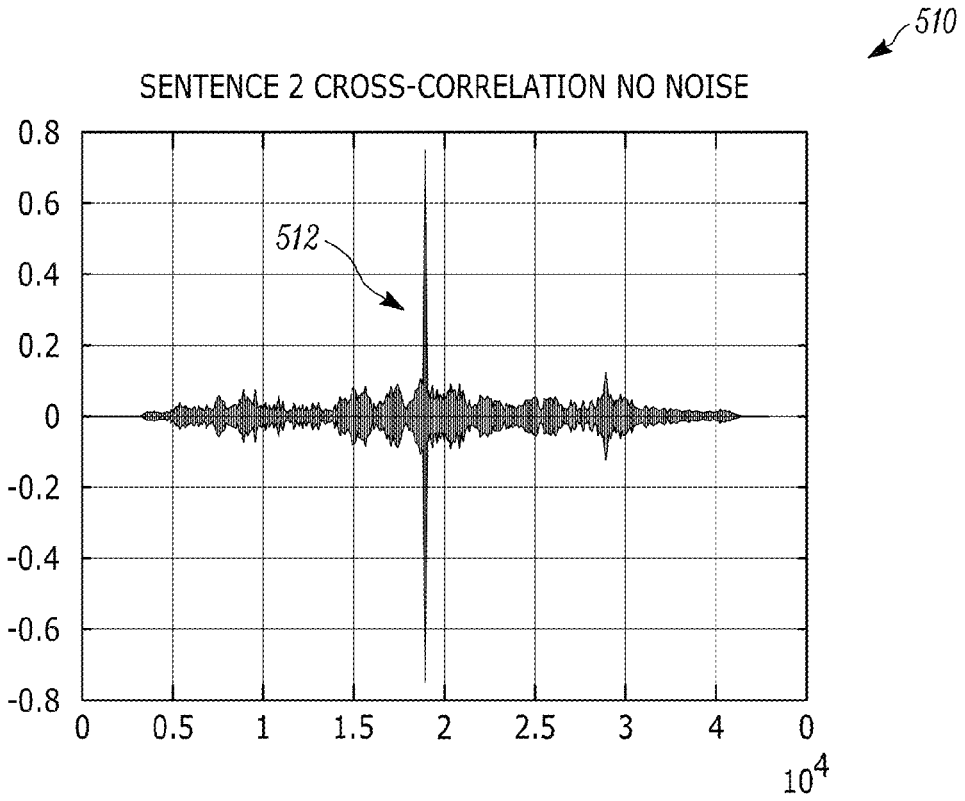
FIG. 5B is a line graph comparing a speech signal, produced in a low ambient noise environment, as received by a microphone array and a vibration microphone, in accordance with some embodiments.

FIG. 5B illustrates a line graph 510 that shows the electrical signals charted in the spectral analysis chart 500. The signals are time aligned, and exhibit a large spike 512, which is indicative of a high degree of correlation between the signals.

Figure 6A:
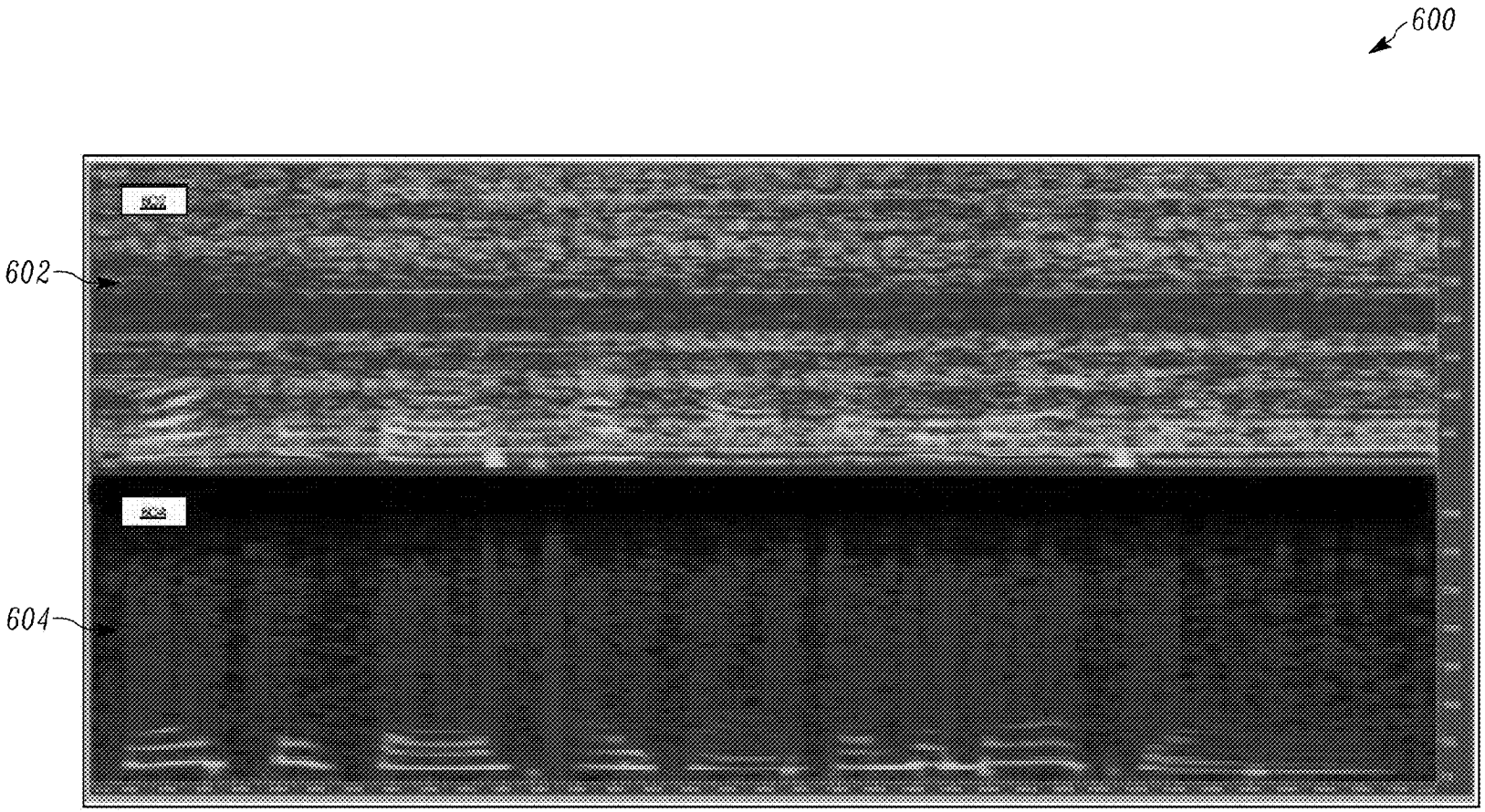
FIG. 6A is a spectral analysis chart of a speech signal, produced in a high ambient noise environment, as received by a microphone array and a vibration microphone, in accordance with some embodiments.

Because the vibration microphone 104 does not capture ambient noise, the high degree of correlation between the signals is also exhibited in noisy environments. For example, FIG. 6A illustrates a spectral analysis chart 600 of the same speech signal charted in FIG. 5A, as produced in a relatively high ambient noise environment. The spectral analysis 602 shows the electrical signals produced by the microphone array 112 in response to receiving the speech sound waves 150 and the ambient sound waves 164. The spectral analysis 602, compared to the spectral analysis 502 (see FIG. 5A), illustrates the decreased signal-to-noise ratio caused by the increased ambient noise. The spectral analysis 604 shows the electrical signals produced by the vibration microphone 104 in response to receiving the speech vibrations 154. Despite the effects of the ambient noise, the chart 600 shows that the electrical signals produced by the microphone array 112 and the vibration microphone 104 continue to exhibit a high degree of correlation in the frequency range of 100 Hz through 1 KHz.

Figure 6B:
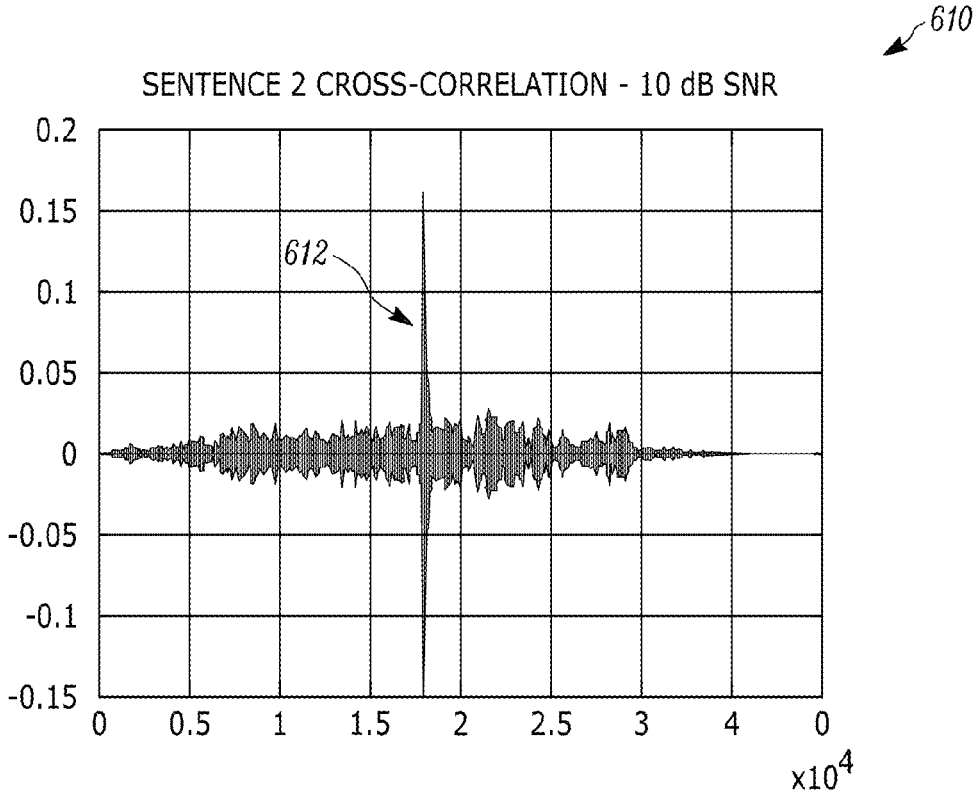
FIG. 6B is a line graph comparing a speech signal, produced in a high ambient noise environment, as received by a microphone array and a vibration microphone, in accordance with some embodiments.

FIG. 6B illustrates a line graph 610, which shows the electrical signals charted in the spectral analysis chart 600. The signals are time aligned, and exhibit a large spike 612, which is indicative of a high degree of correlation between the signals.

As noted above, adaptive beamforming algorithms steer a beam to focus on a desired sound and to attenuate ambient noise. However, when the signal-to-noise ratio between the desired sound and the ambient noise is too low (for example, at or below zero dB), current beamforming algorithms may steer the beam incorrectly, and fail to effectively pick up the desired sound. Accordingly, embodiments provide, among other things, methods for beamforming audio signals received from a microphone array.

By way of example, the methods presented are described in terms of the remote speaker microphone 102, as illustrated in FIG. 1. This should not be considered limiting. The systems and methods described herein could be applied to other forms of electronic communication devices, which utilize beamforming microphone arrays and may be used in high-ambient noise environments (for example, portable radios, mobile telephones, speaker telephones, telephone or radio headsets, video or tele-conferencing devices, and the like). Furthermore, in some embodiments, various functions of the methods may be performed external to the remote speaker microphone 102.

Figure 7:
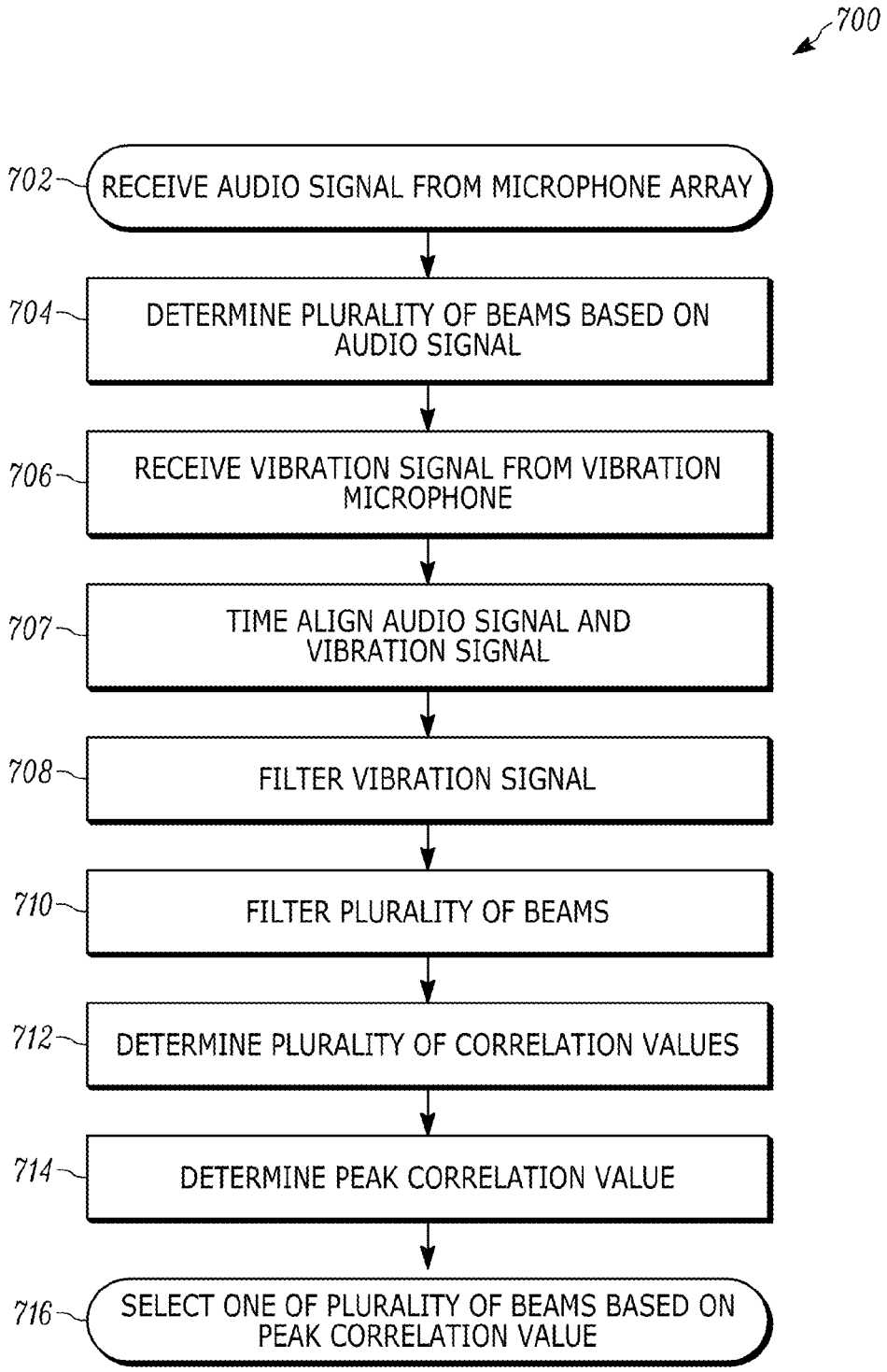
FIG. 7 is a flowchart of a method for beamforming audio signals received from a microphone array in accordance with some embodiments.

FIG. 7 illustrates an exemplary method 700 for beamforming audio signals received from the microphone array 112. At block 702, the electronic processor 106 receives at least one audio signal from the microphone array 112. The audio signal is an electrical signal based on the speech sound waves 150, the ambient sound waves 164, or a combination of both detected by the microphone array 112. At block 704, the electronic processor 106 determines (that is, forms) a plurality of beams based on the audio signal, using a beamforming algorithm.

At block 706, the electronic processor 106 receives at least one vibration signal from the vibration microphone 104. The vibration signal is an electrical signal based on the speech vibrations 154 detected by the vibration microphone 104.

Because the time bases for the acoustic and vibration mics may differ (for example, when the vibration microphone 104 communicates the vibration signal over a wireless link), at block 707, the electronic processor 106 time aligns the vibration signal and the audio signal. For example, where the time bases differ by a constant known delay, the electronic processor 106 may implement an all-pass filter (for example, in the time or frequency domain) that has a group delay equal to the known constant delay that is applied to the leading signal(s). In another example, when the time bases differ by a constant unknown delay, the electronic processor 106 may perform a one-time cross-correlation or similar operation may be used to determine the unknown constant delay, which may then be fed into an all-pass filter and applied to the leading signal(s). In another example, when time bases differ by a varying unknown delay, the electronic processor 106 may periodically calculate a cross-correlation at the output of an adaptive all-pass filter, where the coefficients are adapted to maximize the peak signal power in the cross-correlations.

At block 708, the electronic processor 106 filters the vibration signal. The vibration signal may be filtered by processing the vibration signal through a high-pass filter (for example, with a cutoff frequency of 100 Hz), a low-pass filter (for example, with a cutoff frequency of approximately 1 kHz), or both. The formant content of the speech being detected is proportional to the volume of the speech source 152. Accordingly, some embodiments adjust the low-pass filter adaptively based on the formant context of the speech, to prevent loss of the higher frequency content captured by the vibration microphone 104 under such conditions. In some embodiments, the electronic processor 106 does not filter the vibration signal.

At block 710, the electronic processor 106 filters the plurality of beams to generate a plurality of filtered beams.

In some embodiments, plurality of filtered beams generated by processing the plurality of beams through a low-pass filter (for example, with a cutoff frequency of approximately 1 kHz). In some embodiments, the electronic processor 106 does not filter the plurality of beams.

At block 712, the electronic processor 106 determines a plurality of correlation values (for example, cross-correlation values). Each one of the plurality of correlation values is based on one of the plurality of filtered beams generated at block 710, and the filtered vibration signal. For each of the plurality of filtered beams, the electronic processor 106 determines a value based on the degree of correlation between the two. At block 714, the electronic processor 106 determines the peak correlation value. The peak correlation value is the value that indicates the highest degree of correlation with the filtered vibration signal. Because two signals with a high degree of correlation were likely produced by the same speech input, it can be inferred that the beam associated with the peak correlation value is the beam aligned most closely to the speech source 152.

Accordingly, at block 716, the electronic processor 106 selects one of the plurality of beams based on the peak correlation value. The electrical signal produced by the selected beam may then be further processed (for example, by using other noise reduction algorithms) or transmitted to the portable radio 120 for voice encoding and transmission.

Figure 8:
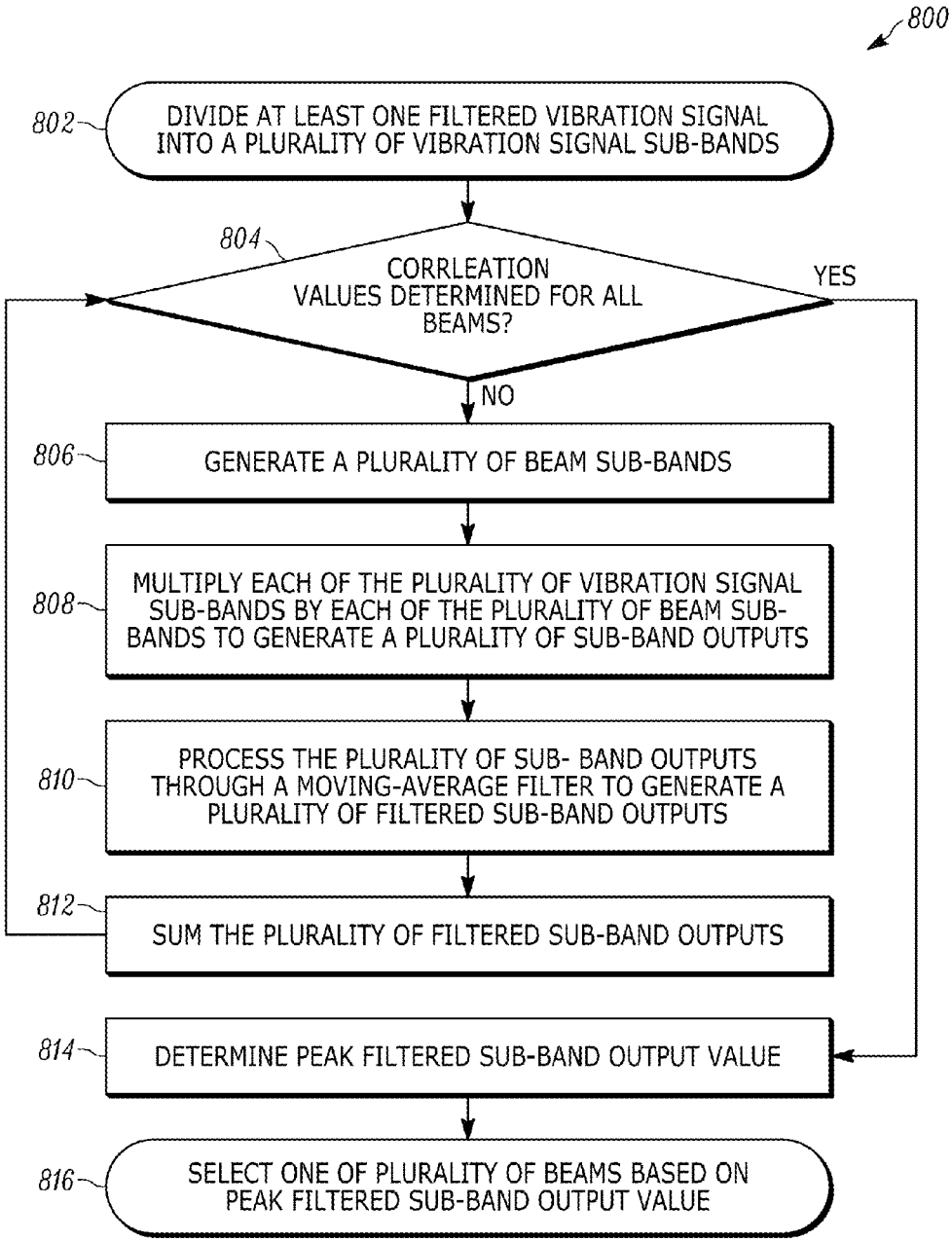
FIG. 8 is a flowchart of a method for beamforming audio signals received from a microphone array in accordance with some embodiments.

In some embodiments, the correlation values may be power values. FIG. 8 illustrates an exemplary method 800 for beamforming audio signals received from the microphone array 112 using power values. The method 800 begins with a plurality of filtered beams and at least one filtered vibration signal, as determined using the method 700.

At block 802, the electronic processor 106 divides the filtered vibration signal into a plurality of vibration signal sub-bands between, for example, 100 Hz and approximately 1 KHz. At block 804, the electronic processor 106 determines whether a correlation value has been determined for each of the plurality of filtered beams. When there are unprocessed filtered beams, the electronic processor 106 divides the next of the plurality of beams to be processed into sub-bands (for example, 100 Hz and approximately 1 KHz), to generate a plurality of beam sub-bands, at block 806.

At block 808, the electronic processor 106 multiplies each of the plurality of vibration signal sub-bands by each of the plurality of beam sub-bands to generate a plurality of sub-band outputs. At block 810, the electronic processor 106 processes the plurality of sub-band outputs through a moving-average filter (for example, a fast Fourier transformation) to generate a plurality of filtered sub-band outputs. In some embodiments, the corner frequency of the moving-average filter is selected to match the cross-correlation length that is being emulated (for example, one second). The number of sub-bands generated at blocks 802 and 804 may be based on the fast Fourier transformation used at block 810. For example, a 128-point fast Fourier transformation would result in twenty-eight sub-bands, while a 512-point fast Fourier transformation would result in 115 sub-bands.

At block 812, the plurality of filtered sub-band outputs is summed to determine a correlation value for the filtered beam being processed. Returning to block 804, when correlation values have been determined for each of the plurality of filtered beams, the electronic processor 106 determines a peak filtered sub-band output value at block 814. The peak filtered sub-band output value corresponds to the beam with the highest signal power. At block 816, the electronic processor 106 selects one of the plurality of beams based on the peak filtered sub-band output value. The electrical signal produced by the selected beam may then be further processed (for example, by using other noise reduction algorithms) or transmitted to the portable radio 120 for voice encoding and transmission.

Accordingly, by use of the method 700 or the method 800, a beamforming algorithm may be used effectively in low signal-to-noise environments, where it may otherwise be ineffective.

Some embodiments may integrate the vibration mic signal into an adaptive beamforming algorithm more directly. That is, instead of using the correlation with the vibration mic signal to choose between beams, the correlation between the vibration signal and the audio signal could be used to assist in the formation of the beams to steer the beams more directly to the source of the speech. To do this, the correlation of the beams to the vibration signal would be used in determining the beamforming algorithm weights.

An adaptive beamformer uses an adjustable set of weights (for example, filter coefficients) to combine multiple microphone sources into a single signal with improved spatial directivity. The adaptive beamforming algorithm uses numerical optimization to modify or update these weights as the environment varies. Such algorithms use many possible optimization schemes (for example, least mean squares, sample matrix inversion, and recursive least squares). Such optimization schemes depend on what criteria are used as an objective function (that is, what parameter to optimize). For example, when the main lobe of a beam is in a known fixed direction, beamforming could be based on maximizing signal-to-noise ratio or minimizing total noise not in the direction of the main lobe, thereby steering the nulls to the loudest interfering source.

When extra information about a user's speech is known (for example, the vibration signal described above), the extra information can be incorporated into the objective function. For example, rather than maximizing signal-to-noise ratio or minimizing noise variance as the objective function, the numerical optimization could adapt the weights to maximize the correlation of the beamformer output with the vibration microphone signal. This objective function would have the advantage of being able to steer the main lobe as well as the nulls, because the beamformer has information about where the desired speech signal is, and it does not have to assume a fixed beam direction. Such a beamformer could improve signal-to-noise ratio by both increasing the desired signal and decreasing competing noise. In some embodiments, this may be combined with a constraint on the main beamforming lobe to keep it within a limited range.

In some embodiments, the beamforming algorithms may be modified based on where the audio and vibration signals most strongly correlate. For example, in a time domain beamformer, the beamformer may band limit the signals before calculating the correlation for the objective function. In some embodiments, for example in a multiband or frequency domain beamformer, the correlation-based objective may be used for the frequency bands in which the correlation holds, while the other bands may use the more standard objective functions. In some embodiments, frequency bands outside the correlation range, but close to it, could be constrained to be in the same or similar shape to the bands within the correlation range.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A method for beamforming audio signals received from a microphone array, the method comprising:

receiving, by an electronic processor communicatively coupled to the microphone array, at least one audio signal from the microphone array;

determining a plurality of beams based on the at least one audio signal;

receiving, by the electronic processor, from a vibration microphone communicatively coupled to the electronic processor, at least one vibration signal;

time aligning the at least one audio signal and the at least one vibration signal;

determining a plurality of correlation values, each of the plurality of correlation values based on one of the plurality of beams and the at least one vibration signal;

determining a peak correlation value based on the plurality of correlation values; and selecting one of the plurality of beams based on the peak correlation value.

2. The method of claim 1, further comprising:

filtering the at least one vibration signal to generate at least one filtered vibration signal; and filtering the plurality of beams to generate a plurality of filtered beams;

determining each of the plurality of correlation values based on one of the plurality of filtered beams and the at least one filtered vibration signal.

3. The method of claim 2, wherein filtering the at least one vibration signal includes processing the at least one vibration signal through a high-pass filter.

4. The method of claim 2, wherein filtering the at least one vibration signal includes processing the at least one vibration signal through a low-pass filter.

5. The method of claim 4, further comprising:

adjusting the low-pass filter based on the formant content of the vibration signal.

6. The method of claim 2, wherein filtering the plurality of beams includes processing the plurality of beams through a low-pass filter.

7. The method of claim 1, wherein receiving at least one vibration signal includes receiving at least one vibration signal from at least one of a group consisting of an optical microphone, a bone conduction microphone, an in-ear microphone, and a tooth bone conduction microphone.

8. The method of claim 1, wherein determining the plurality of correlation values includes determining a plurality of cross-correlation values, each of the plurality of cross-correlation values based on one of the plurality of beams and the at least one vibration signal.

9. The method of claim 1, wherein determining the plurality of correlation values includes dividing the at least one vibration signal into a plurality of vibration signal sub-bands;

for each of the plurality of beams;

generating a plurality of beam sub-bands;

multiplying each of the plurality of vibration signal sub-bands by each of the plurality of beam sub-bands to generate a plurality of sub-band outputs;

processing the plurality of sub-band outputs through a moving-average filter to generate a plurality of filtered sub-band outputs;

summing the plurality of filtered sub-band outputs; and determining a peak filtered sub-band output value based on the plurality of filtered sub-band outputs;

wherein a corner frequency of the moving-average filter is selected to match a cross-correlation length; and wherein selecting one of the plurality of beams includes selecting one of the plurality of beams based on the peak filtered sub-band output value.

10. A beamforming system comprising:

a microphone array;

a vibration microphone; and an electronic processor communicatively coupled to the microphone array and the vibration microphone, and configured to receive at least one audio signal from the microphone array;

determine a plurality of beams based on the at least one audio signal;

receive from the vibration microphone at least one vibration signal;

time align the at least one audio signal and the at least one vibration signal;

determine a plurality of correlation values, each of the plurality of correlation values based on one of the plurality of beams and the at least one vibration signal;

determine a peak correlation value based on the plurality of correlation values; and select one of the plurality of beams based on the peak correlation value.

11. The system of claim 10, wherein the electronic processor is configured to filter the at least one vibration signal to generate at least one filtered vibration signal;

filter the plurality of beams to generate a plurality of filtered beams;

determine each of the plurality of correlation values based on one of the plurality of filtered beams and the at least one filtered vibration signal.

12. The system of claim 10, wherein the vibration microphone is one of a group consisting of an optical microphone, a bone conduction microphone, an in-ear microphone, and a tooth bone conduction microphone.

13. The system of claim 10, wherein the electronic processor is configured to process the at least one vibration signal through a high-pass filter.

14. The system of claim 10, wherein the electronic processor is configured to process the at least one vibration signal through a low-pass filter.

15. The system of claim 14, wherein the electronic processor is configured to adjust the low-pass filter based on the formant content of the vibration signal.

16. The system of claim 10, the electronic processor is configured to process the plurality of beams through a low-pass filter.

17. The system of claim 10, wherein the plurality of correlation values includes a plurality of cross-correlation values, each of the plurality of cross-correlation values based on one of the plurality of beams and the at least one vibration signal.

18. The system of claim 10, wherein the electronic processor is configured to divide the at least one vibration signal into a plurality of vibration signal sub-bands; and for each of the plurality of beams;

generate a plurality of beam sub-bands;

multiply each of the plurality of vibration signal sub-bands by each of the plurality of beam sub-bands to generate a plurality of sub-band outputs;

process the plurality of sub-band outputs through a moving-average filter to generate a plurality of filtered sub-band outputs;

sum the plurality of filtered sub-band outputs;

determine a peak filtered sub-band output value based on the plurality of filtered sub-band outputs; and select one of the plurality of beams based on the peak filtered sub-band output value;

wherein a corner frequency of the moving-average filter is selected to match a cross-correlation length.

19. A remote speaker microphone comprising:

a microphone array;

a vibration microphone; and an electronic processor communicatively coupled to the microphone array and the vibration microphone, and configured to receive at least one audio signal from the microphone array;

determine a plurality of beams based on the at least one audio signal;

receive from the vibration microphone at least one vibration signal;

filter the at least one vibration signal to generate at least one filtered vibration signal;

filter the plurality of beams to generate a plurality of filtered beams;

determine a plurality of correlation values, each of the plurality of correlation values based on one of the plurality of filtered beams and the at least one filtered vibration signal;

determine a peak correlation value based on the plurality of correlation values; and select one of the plurality of beams based on the peak correlation value.

20. A beamforming system comprising:

a microphone array;

a vibration microphone; and an electronic processor communicatively coupled to the microphone array and the vibration microphone, and configured to receive at least one audio signal from the microphone array;

receive from the vibration microphone at least one vibration signal;

time align the at least one audio signal and the at least one vibration signal;

determine at least one correlation value based on the at least one audio signal and the at least one filtered vibration signal;

determine a plurality of adaptive beamforming algorithm weights based on the at least one correlation value; and generate a beam based on the plurality of adaptive beamforming algorithm weights.

* * * * *